US006675972B2

(12) United States Patent
Patterson

(10) Patent No.: US 6,675,972 B2
(45) Date of Patent: Jan. 13, 2004

(54) CHILDPROOF BLISTER PACKAGING

(75) Inventor: David Hugh Patterson, Heswall (GB)

(73) Assignee: ADS Graphics Limited, Deeside (GB)

( * ) Notice: Subject to any disclaimer, the term of this patent is extended or adjusted under 35 U.S.C. 154(b) by 32 days.

(21) Appl. No.: 10/026,817

(22) Filed: Dec. 27, 2001

(65) Prior Publication Data

US 2003/0006163 A1 Jan. 9, 2003

(30) Foreign Application Priority Data

Jul. 5, 2001 (GB) ..... 0116351

(51) Int. Cl.[7] ..... B65D 83/04; B65D 73/00
(52) U.S. Cl. ..... 206/531; 206/532; 206/468
(58) Field of Search ..... 206/531, 530, 206/532, 538, 539, 468, 462, 463; 221/302, 305; 229/87.2, 92.9

(56) References Cited

U.S. PATENT DOCUMENTS 2,971,638 A * 2/1961 Allison et al. ..... 206/532
3,182,789 A * 5/1965 Sparks ..... 206/536
4,125,190 A * 11/1978 Davie et al. ..... 206/532
5,244,091 A * 9/1993 Tannenbaum ..... 206/531
5,915,559 A * 6/1999 Hulick et al. ..... 206/536
6,138,830 A * 10/2000 Muggli ..... 206/532
6,394,275 B1 * 5/2002 Paliotta et al. ..... 206/531

* cited by examiner

*Primary Examiner*—Mickey Yu
*Assistant Examiner*—John G. Pickett
(74) *Attorney, Agent, or Firm*—Dennison, Schultz & Dougherty

(57) ABSTRACT

A childproof packaging having three portions which are formed from a single sheet of suitable card or plastics material. In use, a blister pack is placed into the first portion having apertures which correlate with a respective cup or indentation in the blister pack. The second portion is then folded onto the top of the penetrable foil lid of the blister pack, and the third portion is then folded on top of the second portion and sealed with a suitable adhesive. The second portion has a plurality of closures moveable by application of a suitable yield force, between a first position, which blocks access to the outlet of a respective compartment of the blister pack, and a second position which provides access to the outlet. The closure can be moved by placing an elongate member into a slotted aperture in the third portion and then pushing the moveable closure to the second position.

19 Claims, 5 Drawing Sheets

CHILDPROOF BLISTER PACKAGING

BACKGROUND OF THE INVENTION

This invention relates to a childproof blister packaging. In particular, this invention relates to a childproof packaging for readily dispensing tablets or capsules to adults whilst preventing inadvertent access by children or other minors to said tablets or capsules stored in an appropriate blister pack.

In recent years, childproof containers for protecting the inadvertent consumption of pharmaceutical products by children or other minors have become commonplace. Generally, these arrangements comprise of a container having a lid or closure which can only be removed by firstly depressing the lid or closure against a resilient locking mechanism. The strength of the locking mechanism is such that children or other minors are not able to release the lid or closure. Whilst these containers have proven popular, the increasing use of blister packs has reintroduced the danger of uncontrolled consumption of pharmaceutical products by children or other minors.

The most common form of blister pack generally consists of a plastic base material having a plurality of cups or indentations into which the tablets are placed. A penetrable foil lid is then sealed to the base web and, in use, the tablets are simply pressed through the penetrable lid by the user. Whilst these blister packs provide a simple and convenient way to store and dispense medication, they are however open to potential misuse and inadvertent access by children. To increase child safety, simple techniques such as increasing the foil thickness have been proposed to make the opening of the pack more difficult. However, this can also cause problems to senior citizens or other adults suffering from physically debilitating disabilities, such as arthritis or rheumatism.

SUMMARY OF THE INVENTION

It is the object of the present invention to provide a childproof blister packaging for readily dispensing tablets or capsules to adults whilst preventing inadvertent access by children or other minors. The present invention enabling the secure storage of pharmaceutical products in a simple and economic package, which also provides for ease of assembly. It is a further object of the present invention to provide a childproof blister packaging that can be easily used by senior citizens or other adults suffering from physically debilitating disabilities.

According to the present invention there is provided a childproof packaging for readily dispensing tablets or capsules to adults whilst preventing inadvertent access by children or other minors, each of said tablets or capsules being held in each respective compartment of a blister pack, the outlet of each respective compartment being covered by a penetrable lid, said childproof packaging comprising:

- a first portion having at least one aperture which correlates with each respective compartment of said blister pack, and which allows user access to each respective compartment of said blister pack;
- a third portion having at least one aperture which correlates with the outlet of each respective compartment being covered by a penetrable lid on said blister pack, and which allows user access to the penetrable lid of each respective compartment of said blister pack; and
- a second portion being located between said penetrable lid on said blister pack and said third portion, and having at least one cover means releasably secured in a first position which blocks access to the outlet of each respective compartment of said blister pack, and whereby each respective cover means can be moved under a suitable yield force to a second position by way of means for enabling access on said third portion, thereby exposing the penetrable lid of each respective compartment of said blister pack and allow the respective tablet or capsule to be pushed therethrough.

In a preferred embodiment, the first, second and third portions are formed from a suitable card or plastics material. Preferably, the first, second and third portions are formed from a single sheet of suitable card or plastics material. In use, the first and third portions cover the rear and front portions of said childproof packaging respectively. The second portion being located behind the third portion of said childproof packaging to completely envelop the blister pack. The second and third portions may be sealed together using a suitable adhesive or other fixing means.

In use, said at least one cover means on said second portion comprises a suitable card or plastics material. The cover means further comprises a moveable closure being releasably secured in a first position using, preferably, a plurality of perforations. Access to said cover means being provided by means for enabling access on said third portion which may comprise a suitable slotted aperture, and through which the user can insert a suitable elongate member such as, for example, a pen or key. In use, each respective cover means can be moved to a second position, using any suitable elongate member, to permit user access to the respective tablet or capsule, under a suitable yield force which is greater than that established by a child or other minor. In this way, a child or other minor could not possess the sufficient skill, strength and dexterity required to manipulate the suitable elongate member and push the cover means to a second position under a suitable yield force, through the slotted aperture on the third portion. Further preferably, said suitable yield force is not too excessive as to preclude use by senior citizens or other adults suffering from physically debilitating disabilities.

In use, the apertures on the first, second and third portions can be arranged as to accommodate any combination of cups or indentations on the blister pack.

Also according to the present invention there is provided a blank for forming a childproof packaging for readily dispensing tablets or capsules to adults whilst preventing inadvertent access by children or other minors, each of said tablets or capsules being held in each respective compartment of a blister pack, the outlet of each respective compartment being covered by a penetrable lid, said blank comprising:

- first and third panels for forming first and third portions and having suitable apertures for receiving a blister pack containing tablets or capsules; and
- a second panel for forming a second portion and having a plurality of cover means releasably secured in a first position and suitable for covering the outlet of each respective compartment, each of said cover means being capable of being slideably moved under a suitable yield force to a second position to allow user access to each respective compartment.

Further according to the present invention there is provided a method of forming a childproof packaging for readily dispensing tablets or capsules to adults whilst preventing inadvertent access by children or other minors, each of said tablets or capsules being held in each respective compartment of a blister pack, the outlet of each respective compartment being covered by a penetrable lid, the method comprising the steps of:

locating said blister pack onto a first panel of said childproof packaging, said first panel having at least one aperture for receiving each respective compartment of said blister pack;

folding a second panel of said childproof packaging over the penetrable lid of said blister pack, said second panel having at least one cover means releasably secured in a first position and suitable for covering the outlet of each respective compartment of said blister pack, each of said cover means being capable of being slideably moved under a suitable yield force to a second position to allow user access to each respective compartment of said blister pack; and folding and securing a third panel of said childproof packaging over said second panel, said third panel having at least one aperture which correlates with the outlet of each respective compartment being covered by the penetrable lid on said blister pack.

In a preferred embodiment, said blank for forming a childproof packaging may be formed from a single sheet of suitable card or plastics material. In use, fold lines or lines of weakness are provided between the first and second panels and said second and third panels. Further preferably, the third panel having means for enabling access to each of said cover means on said second panel which may comprise a slotted aperture. Preferably, each of said cover means on said second panel comprises a slotted aperture having a moveable closure being releasably secured in a first position using a plurality of perforations. In use, user access to each respective compartment of said blister pack is achieved by pushing the moveable closure on the second panel through the third panel using any suitable elongate member such as, for example, a pen or key. The slotted aperture may also be closed by a tear-off portion for additional security.

The advantages of the present invention are that a childproof blister packaging for readily dispensing tablets or capsules to adults whilst preventing inadvertent access by children or other minors, is provided. The childproof blister packaging enabling the secure storage of pharmaceutical products in a simple and economic package, which also provides for ease of assembly. The childproof blister packaging that can be easily used by senior citizens or other adults suffering from physically debilitating disabilities.

It will be obvious to those skilled in the art that variations of the present invention are possible and this is intended that the present invention may be used other than as specifically described herein.

BRIEF DESCRIPTION OF THE DRAWINGS

A specific non-limiting embodiment of the invention will be described by way of example and with reference to the accompanying drawings in which.

DESCRIPTION OF THE PREFERRED EMBODIMENTS

Figure 1:
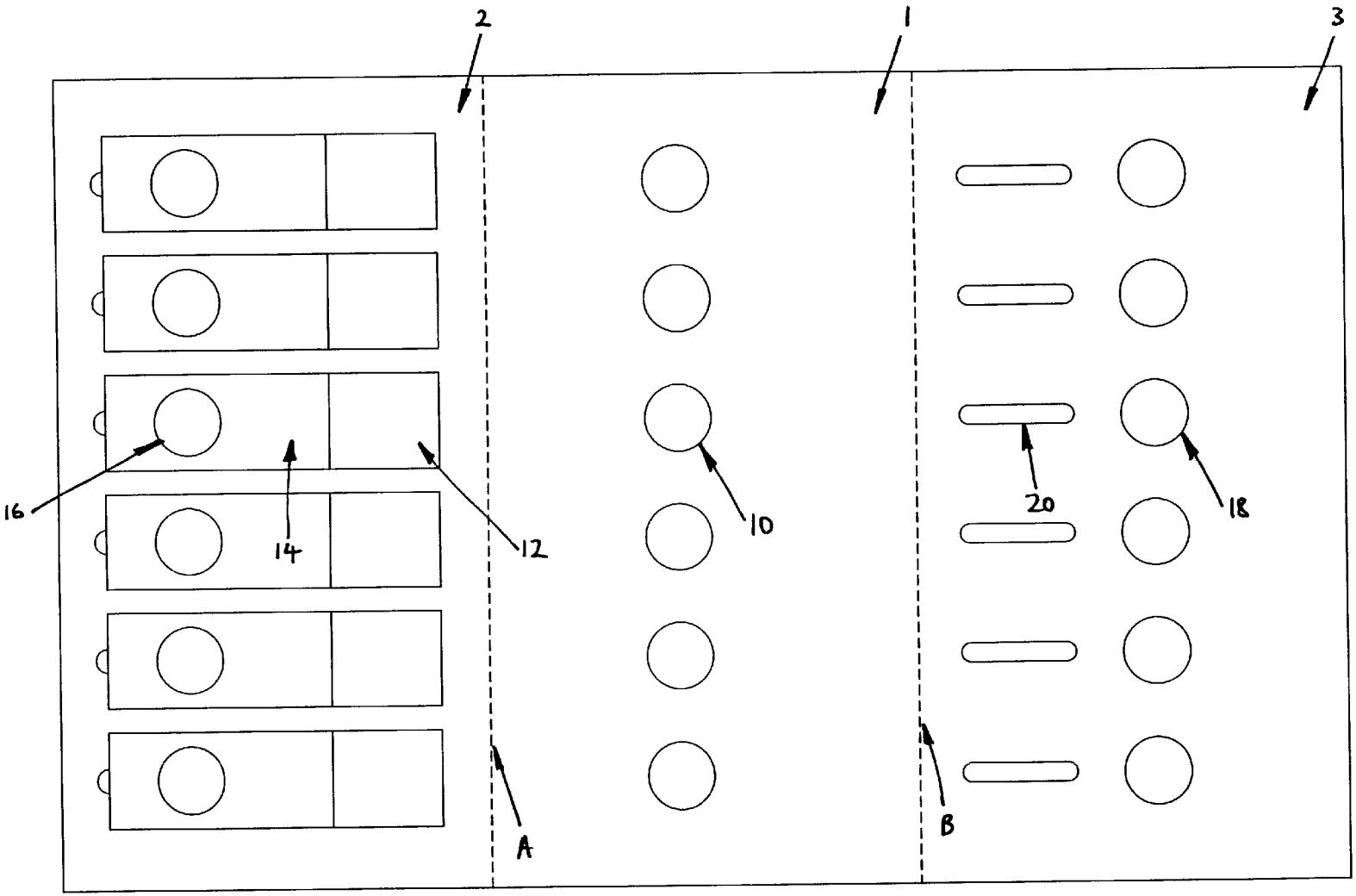
FIG. 1 shows a plan view of a blank according to the present invention.

Referring now to the drawings, a blank for forming the childproof blister packaging according to the present invention is illustrated in FIG. 1. For reasons of clarity, a childproof packaging suitable for enveloping a blister pack having only a single row of tablets or capsules is described. However, in use, the present invention can be implemented for blister packs having a plurality of rows of tablets or capsules, or indeed any arrangement thereof.

As shown in FIG. 1, the blank for forming the childproof blister packaging consists of three portions 1, 2 and 3. In particular, the first portion 1 has a plurality of apertures 10 which correlate with each respective cup or compartment of the blister pack. In use, the first portion 1 is connected to the second portion 2 via fold line A.

When assembled, the second portion 2 is located between the penetrable foil lid of the blister pack and the third portion 3. The second portion 2 having a plurality of moveable closures 14 being releasably secured in a plurality of slotted apertures 12. In use, each of the moveable closures 12 is releasably secured in a first position, which blocks access to the outlet of each respective compartment of the blister pack, via perforations which can only break under a suitable yield force.

When assembled, the first portion 1 is also connected to the third portion 3 via fold line B. The third portion 3 is also folded on top of the second portion 2 and sealed with a suitable adhesive. In this way, access to the tablets or capsules held in the blister pack can only be achieved by placing an elongate member, such as a pen or key, into the slotted aperture 20 on the third portion 3 and then pushing the moveable closure 14 on the second portion 2 to a second position. At this point, apertures 10, 16 and 18 are all correlated and the penetrable lid of the blister pack is exposed. The user can then simply push the respective tablet or capsule through the penetrable foil lid.

In use, the force that is required to displace the moveable closure 14 from its first position is determined by the number and thickness of the perforations connecting the moveable closure 14 to the second portion 2 inside slotted aperture 12. Generally speaking, the force required must be greater than that established by a child or other minor, although not too great as to preclude use by senior citizens or other adults suffering from physically debilitating disabilities. In this way, a child or other minor could not possess the sufficient skill, strength and dexterity required to manipulate the suitable elongate member and push the moveable closure 14 to a second position under a suitable yield force, through the slotted aperture 20 on the third portion 3.

Figure 2:
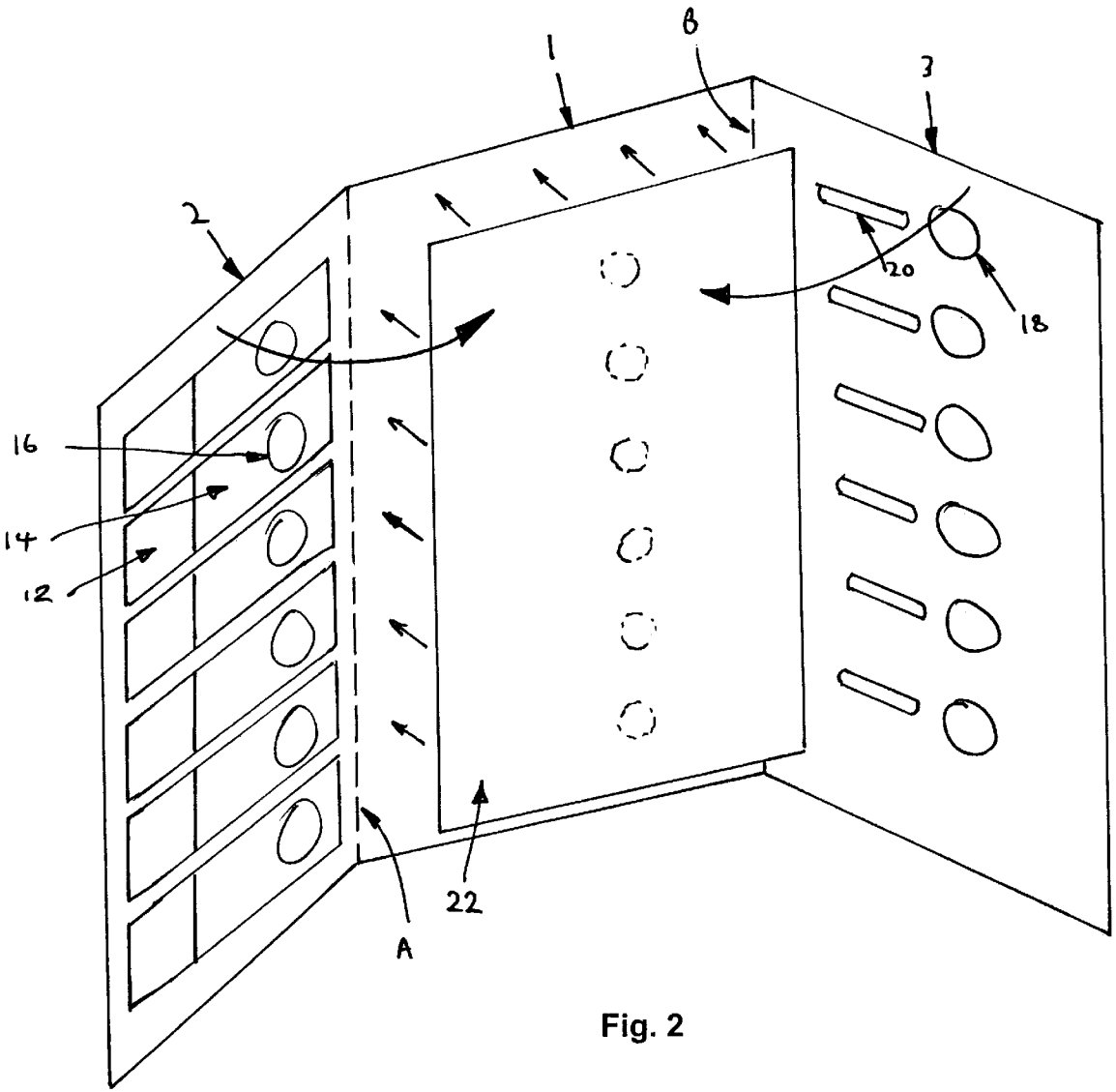
FIG. 2 illustrates a perspective view of the implementation of the present invention.

FIG. 2 shows further detail of the implementation of the present invention and specifically how the childproof packaging envelops the blister pack. Again, only a single row of tablets or capsules on the blister pack is illustrated to improve the overall clarity. In use, the blister pack 22 is placed into the first portion 1 having apertures 10 which correlate with each respective cup or indentation on the blister pack 22. The second portion 2 is then folded, via line of weakness A, onto the top of the penetrable foil lid of the blister pack 22, and the third portion 3 is then folded on top of the second portion 2, via line of weakness B, and sealed with a suitable adhesive. The first 1 and third portions 3 then form the outer envelope of the childproof packaging, and access to the tablets held in the blister pack can only be made when apertures 10, 16 and 18 are all correlated.

Figure 3:
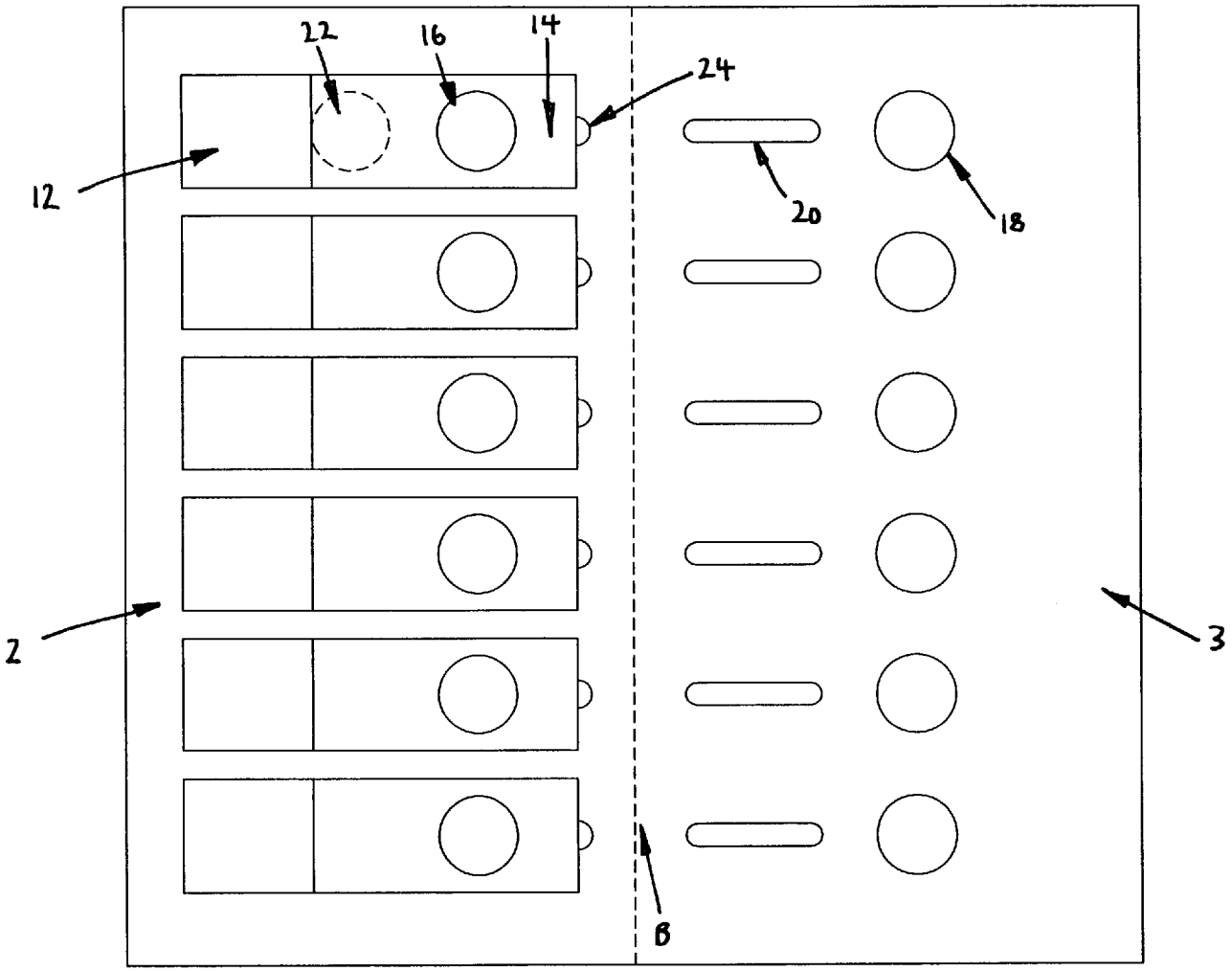
FIG. 3 shows a plan view of further detail of how the moveable closure locates in the closed position.
Figure 4:
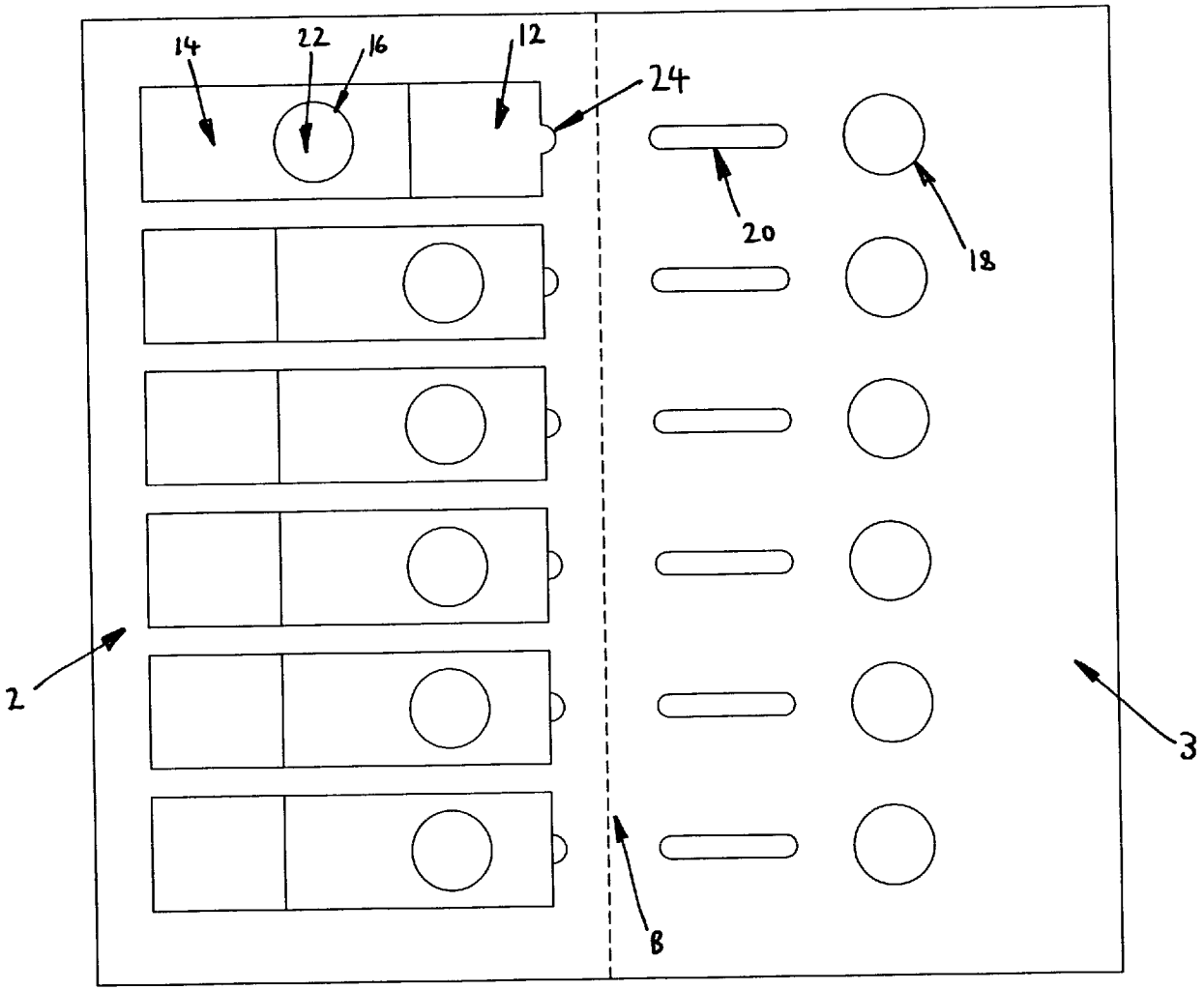
FIG. 4 illustrates a plan view of further detail of how the moveable closure locates in the open position.

Further detail of the moveable closure 14 on the second portion 2 is detailed in FIGS. 3 and 4. FIGS. 3 and 4 depict the present invention partly assembled, with the first 1 and second portions 2 enveloping the blister pack 22.

FIG. 3 shows how the each of the moveable closures 14 are located in a first position which blocks access to the outlet of the respective compartments of the blister pack 22. FIG. 4 illustrates how the uppermost moveable closure 14 on the second position 2 is located in second position, thereby enabling apertures 10 and 16 to correlate with the outlet of the penetrable lid of the blister pack 22, and thereby enabling the user to easily push a tablet therethrough. Of course, in use, the third portion 3 will be placed on top the second portion 2 and aperture 18 will also line up with aperture 10 on the first portion 1. Means for enabling access 20 to each of the moveable closures 14 on the second portion 2 consists of a plurality of slotted apertures 20 and a suitable elongate member can used to push the moveable closure 14 to its second position under a suitable yield force.

Figure 5:
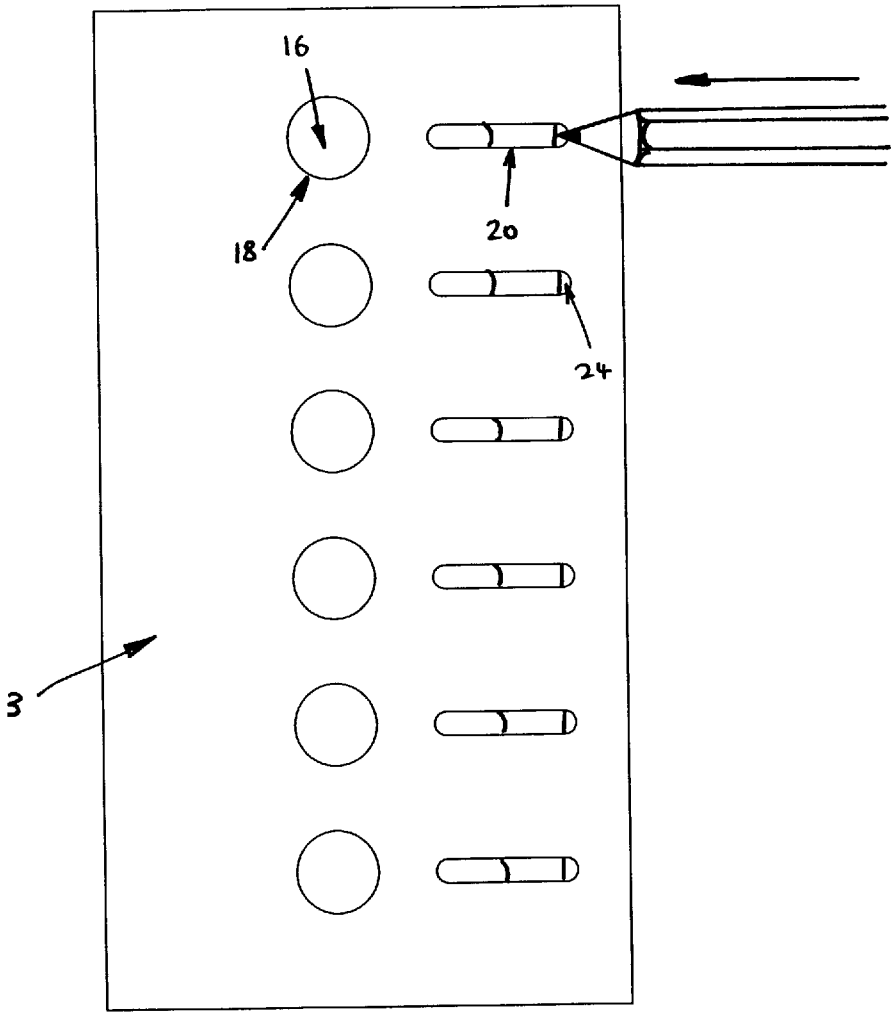
FIG. 5 details how the user is allowed access to tablets or capsules by pushing the moveable closure using a suitable elongate member.

This procedure is also illustrated in FIG. 5, which shows a plan view of the present invention with the first, second and third portions 1, 2 and 3 sealed. In use, the user inserts an elongate member, such as a pen or key, into the gap between slotted aperture 20 on the third portion 3 and tab 24 on the second portion 2. The user then pushes the moveable closure 14 over to its second position, wherein all three apertures 10, 16 and 18 correlate with each other and with the respective compartment of the blister pack. At this point, the user can then simply push the respective tablet or capsule through the penetrable foil lid. The slotted aperture 20 may also be covered by a tear-off portion formed in the third portion 3 for additional security.

Various alterations and modifications may be made to the present invention without departing from the scope of the invention. For example, although particular embodiments refer to folding the first, second and third portions 1, 2 and 3 from a single sheet to envelop the blister pack, this is in no way intended to be limiting as, in use, the present invention may be implemented using separate portions which are secured to one another using a suitable adhesive.

What is claimed is:

1. A childproof packaging for readily dispensing tablets or capsules to adults while preventing inadvertent access by children or other minors, each of said tablets or capsules being held in a respective compartment of a blister pack, each respective compartment of the blister pack having a respective outlet which is covered by a penetrable lid, said childproof packaging comprising:

a first portion having at least one aperture which correlates with a respective compartment of the blister pack, and which allows user access to the respective compartment of the blister pack;

a third portion having at least one aperture which correlates with the outlet of a respective compartment of the blister pack which is covered by penetrable lid and which allows user access to the penetrable lid of a respective compartment of the blister pack, the third portion further comprising a slotted aperture adjacent each respective aperture of said third portion; and a second portion which is disposed in use between said penetrable lid on the blister pack and said third portion, and having at least one cover means releasably secured in a first position which blocks access to the outlet of a respective compartment of the blister pack, and which is movable to a second position under a suitable yield force in which the penetrable lid of a respective compartment of the blister pack is exposed to allow a tablet or capsule to be pushed therethrough, and a tab, wherein a respective cover means is aligned in use with a respective slotted aperture such that the respective cover means is movable by insertion of an elongate instrument through the respective slotted aperture into the tab to apply the suitable yield force.

2. A childproof packaging as claimed in claim 1. wherein said first, second and third portions are formed from suitable card or plastics material.

3. A childproof packaging as claimed in claim 1, wherein said first, second and third portions are formed from a single sheet of suitable card or plastics material.

4. A childproof packaging as claimed in claim 1, wherein said first and third portions are constructed and arranged to cover the rear and front portions of a blister pack, respectively.

5. A childproof packaging as claimed in claim 1, wherein said second portion is located between the penetrable lid of the blister pack and the third portion to completely envelop the blister pack.

6. A childproof packaging as claimed in claim 1, wherein said second and third portions are sealed together using a suitable adhesive or other fixing means.

7. A childproof packaging as claimed in claim 1, wherein said at least one cover means is formed from suitable card or plastics material.

8. A childproof packaging as claimed in claim 1, wherein said at least one cover means further comprises a moveable closure being releasably secured in a first position using a plurality of perforations.

9. A childproof packaging as claimed in claim 1, wherein said suitable yield force is greater than that established by a child or other minor.

10. A childproof packaging as claimed in claim 1, wherein said suitable yield force is not too excessive as to preclude use by senior citizens or other adults suffering from physically debilitating disabilities.

11. A childproof packaging as claimed in claim 8, wherein said suitable yield force is determined by the number and thickness of said plurality of perforations connecting said moveable closure to said second portion.

12. A blank or forming a childproof packing for readily dispensing tablets or capsules to adults while preventing inadvertent access by children or other minors, each of said tablets or capsules being held in a respective compartment of a blister pack, each respective compartment having an outlet covered by a penetrable lid, said blank comprising:

a first panel for forming a first portion having suitable apertures for receiving a blister pack containing tablets or capsules;

a second panel for forming a second portion and having a plurality of cover mean releasably secured in a first position and suitable for covering the outlet of each respective compartment, each of said cover means being slideably movable under a suitable yield force to a second position to allow user access to each respective compartment; and a third panel for forming a third portion having suitable apertures which correlate with the outlet of each respective compartment of a blister pack, said third panel including means for enabling access to each of said cover means on said second panel.

13. A blank for forming a childproof packaging as claimed in claim 12, wherein said blank is formed from a single sheet of suitable card or plastics material.

14. A blank for forming a childproof packaging as claimed in claim 12, wherein said plurality of cover means are formed from suitable card or plastics material.

15. A blank for forming a childproof packaging as claimed in claim 12, wherein each of said cover means further comprises a moveable closure being releasably secured in a first position using a plurality of perforations.

16. A blank for forming a childproof packaging as claimed in claim 12, wherein said suitable yield force is determined by the number and thickness of said plurality of perforations connecting said moveable closure to said second portion.

17. A blank for forming a childproof packaging as claimed in claim 12, wherein said means for enabling access further comprises a slotted aperture.

18. A method of forming a childproof packaging for readily dispensing tablets or capsules to adults while preventing inadvertent access by children or other minors, each of said tablets or capsules being held in a respective compartment of a blister pack, each respective compartment having an outlet which is covered by a penetrable lid, the method comprising the steps of:

locating said blister pack onto a first panel of said childproof packaging, said first panel having at least one aperture for receiving a respective compartment of said blister pack;

folding a second panel of said childproof packaging over the penetrable lid of said blister pack, said second panel having at least one cover means releasably secured in a first position covering the outle of a respective compartment of said blister pack, said at least one cover means being slideably movable under a suitable yield force to a second position to allow user access to respective compartment of said blister pack, wherein fold lines or lines of weakness are provided between the first and second panels; and folding and securing a third panel of said childproof packaging over said second panel, said third panel having at least one aperture which correlates with the outlet of each respective compartment being covered by a penetrable lid on said blister pack.

19. A method of claim 18, wherein fold lines or lines of weakness are provided between the first and third panels.

* * * * *